US012667762B1

(12) United States Patent
Marcewicz et al.

(10) Patent No.: US 12,667,762 B1
(45) Date of Patent: Jun. 30, 2026

(54) HANDLE-MOUNTED VIBRATION DAMPENING CLIP FOR BATS

(71) Applicants: Michael Marcewicz, Lakeland, FL (US); Canyon Marcewicz, Lakeland, FL (US)

(72) Inventors: Michael Marcewicz, Lakeland, FL (US); Canyon Marcewicz, Lakeland, FL (US)

( * ) Notice: Subject to any disclaimer, the term of this patent is extended or adjusted under 35 U.S.C. 154(b) by 0 days.

(21) Appl. No.: 19/207,550

(22) Filed: May 14, 2025

(51) Int. Cl.
*A63B 60/54* (2015.01)
*A63B 102/18* (2015.01)

(52) U.S. Cl.
CPC ..... *A63B 60/54* (2015.10); *A63B 2102/18* (2015.10)

(58) Field of Classification Search
CPC ..... A63B 60/54; A63B 2102/18
See application file for complete search history.

(56) References Cited

U.S. PATENT DOCUMENTS 5,069,454 A * 12/1991 Frost ..... A63B 60/08 473/206
6,709,352 B1 * 3/2004 Albin ..... A63B 59/50 473/566
9,643,049 B2 * 5/2017 Bentley ..... A63B 24/0003
10,112,091 B2 * 10/2018 Long ..... A41D 19/0024
10,254,139 B2 * 4/2019 Martin ..... G06F 3/0346

FOREIGN PATENT DOCUMENTS

GB 322512 A * 12/1929 ..... A63B 60/10
JP 2024159373 A * 11/2024

OTHER PUBLICATIONS

Translation of JP 2024159373 A. (Year: 2024).*

* cited by examiner

*Primary Examiner* — Jeffrey S Vanderveen
(74) *Attorney, Agent, or Firm* — Cygnet IP Law; Stephen W. Aycock, II

(57) ABSTRACT

A removable vibration-dampening device configured to clip onto the handle of a baseball bat. The device comprises an inner clip portion formed of semi-rigid material (e.g., PVC) and an outer elastomeric body formed of vibration absorbing material (e.g., polyurethane, silicon, Sorbothane™, etc.).

20 Claims, 10 Drawing Sheets

HANDLE-MOUNTED VIBRATION DAMPENING CLIP FOR BATS

FIELD

Some implementations relate generally to impact-absorbing accessories for handheld sports equipment, and, more particularly, to devices attachable to (and easily removable from) the handle of a baseball or similar bat to reduce vibration and perceived 'sting' upon impact with a ball.

BACKGROUND

Conventional solutions for reducing bat vibration may involve specialized grip tape, internal dampening materials, or the use of gloves. These may be limited in effectiveness, require modification of the bat, or introduce inconvenience. Embodiments were conceived in light of such problems and limitations. The background description provided herein is for the purpose of generally presenting the context of the disclosure.

Work of the presently named inventor(s), to the extent it is described in this background section, as well as aspects of the description that may not otherwise qualify as conventional solutions at the time of filing, are neither expressly nor impliedly admitted as conventional solutions.

SUMMARY

Some implementations can include a removable clip-on device configured to attach to the handle region of a baseball bat (or other bat) and reduce vibration transmitted to the user's hands during ball contact. The device may comprise a dual-material construction, including a rigid inner clip structure that can be formed of polyvinyl chloride (PVC) with a Shore D hardness of approximately 75, for example, and an outer vibration-dampening (or vibration-absorbing) body composed of polyurethane rubber with a Shore A hardness of approximately 20, for example. In other examples, silicone rubber may be used with bonding enhancement. The outer body may absorb vibrational energy to reduce discomfort.

In contrast to conventional solutions such as grip tape, thumb mounted vibration reducing devices, or internally modified bats, the present invention offers a removable, non-permanent clip-on design that requires no alteration to the bat itself. The device can be quickly attached or detached without tools, accommodates a wide range of bat handle diameters, and provides effective vibration dampening through a dual-material structure. These features collectively enhance user comfort and versatility while simplifying installation and maintenance compared to prior art solutions. Use of the vibration reducing clip can help reduce "sting" from the bat and may also help improve ball speed after being struck by the bat.

DETAILED DESCRIPTION

Figure 1:
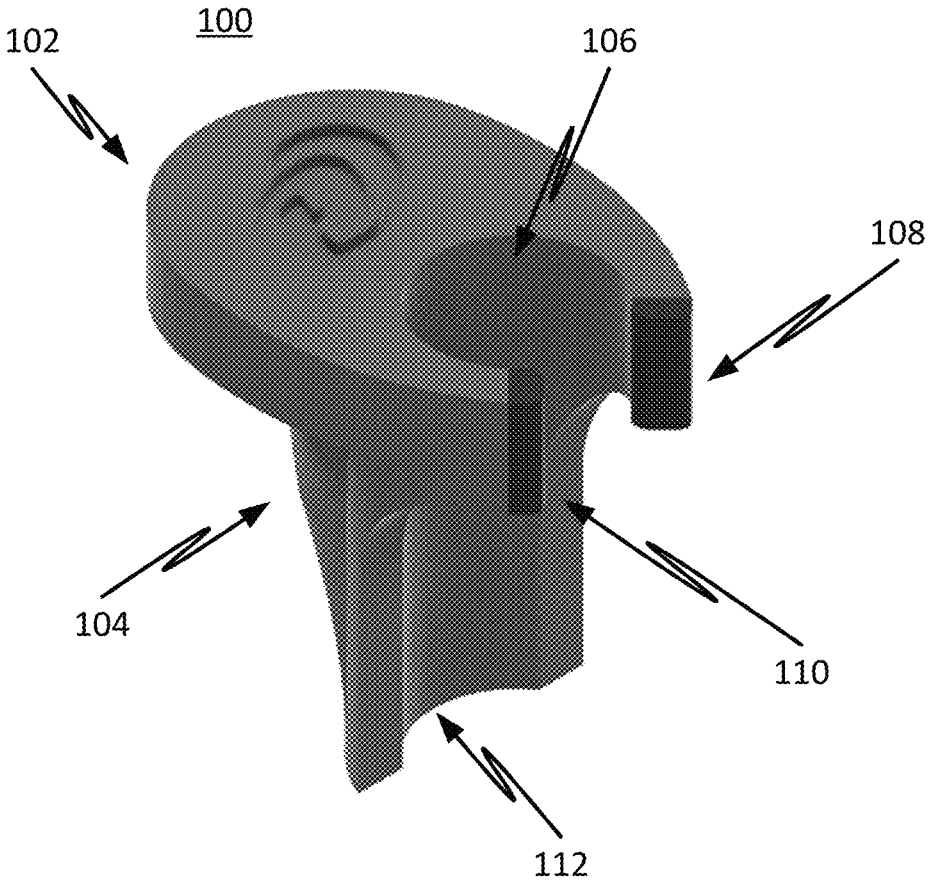
FIGS. 1-3 are diagrams showing an example first embodiment of a vibration reducing clip in accordance with some implementations.
Figure 2:
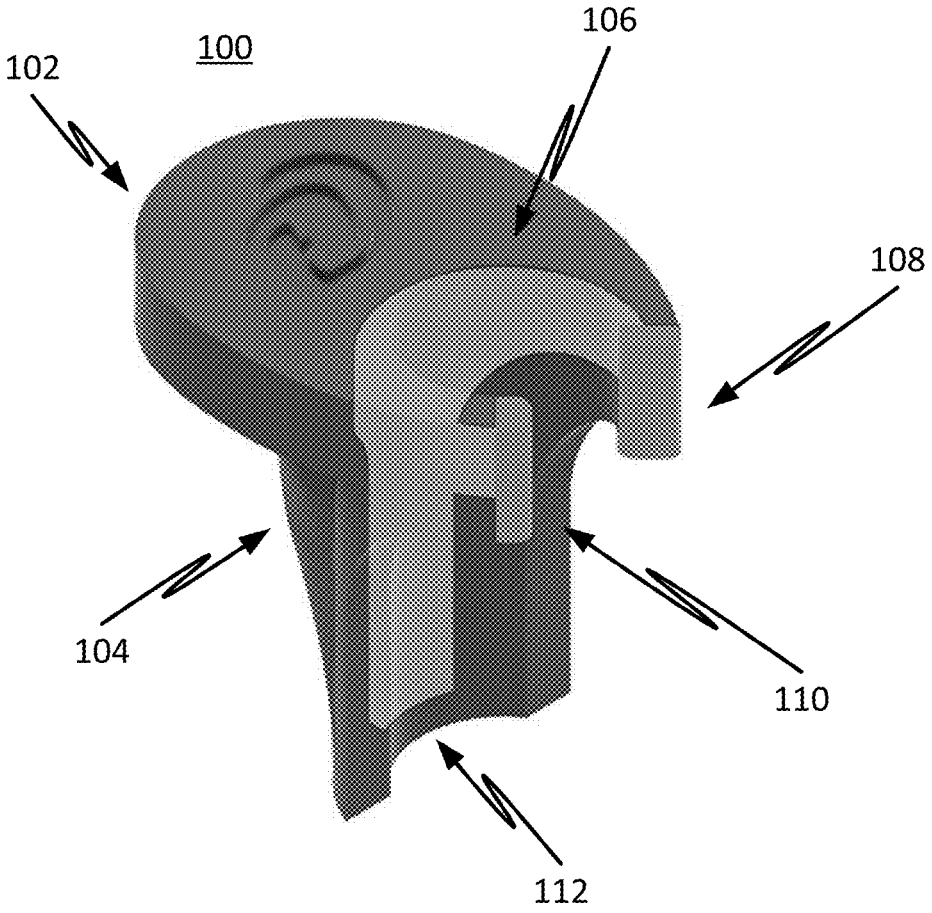
Figure 3:
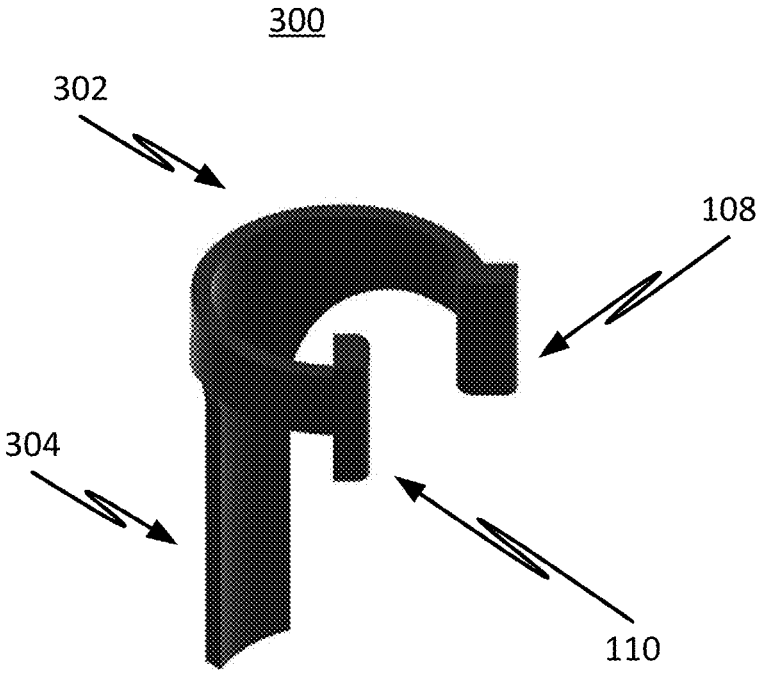
Figure 4:
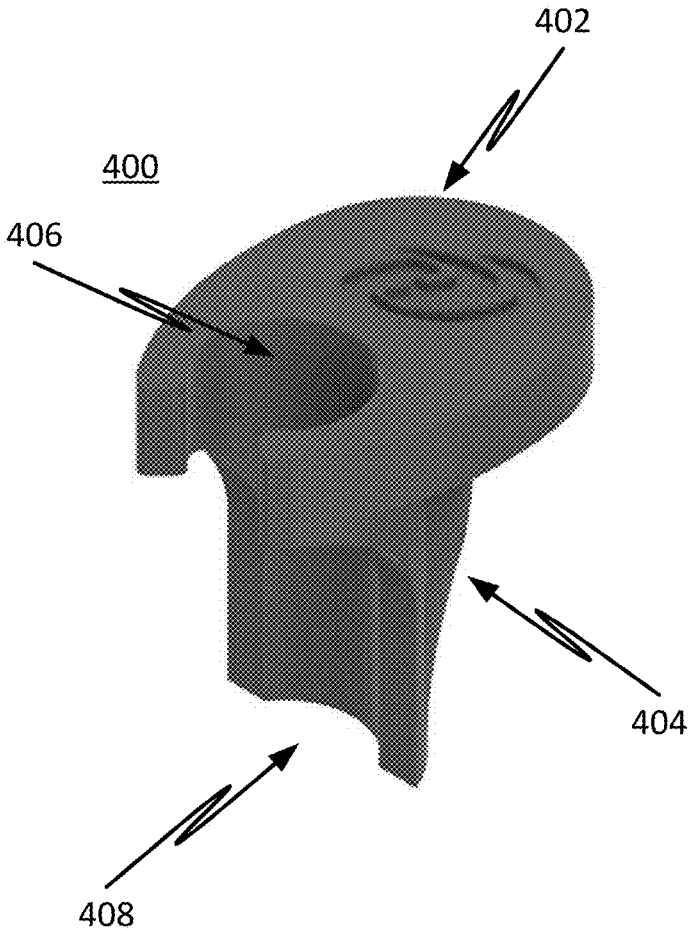
FIGS. 4-7 are diagrams showing an example second embodiment of a vibration reducing clip in accordance with some implementations.
Figure 5:
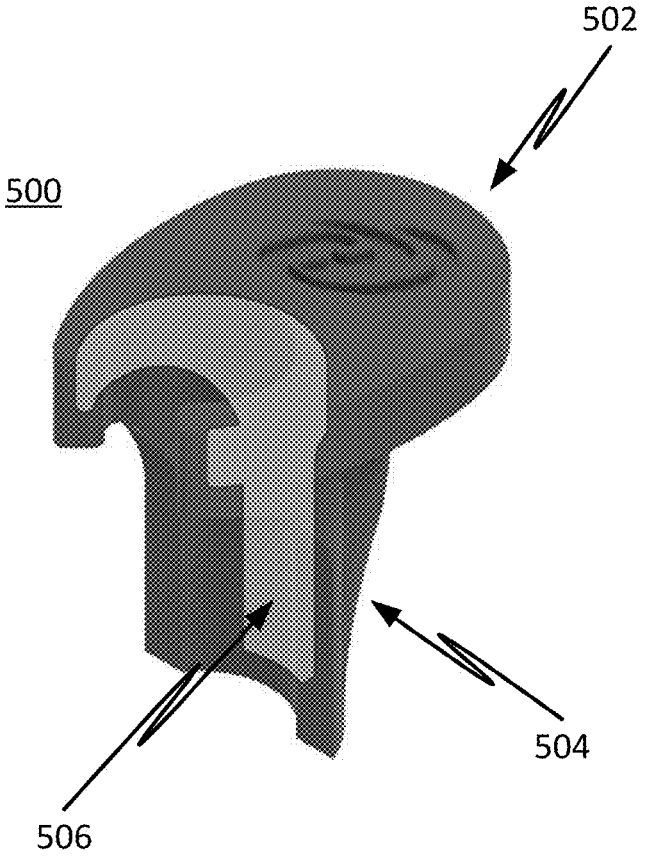
Figure 6:
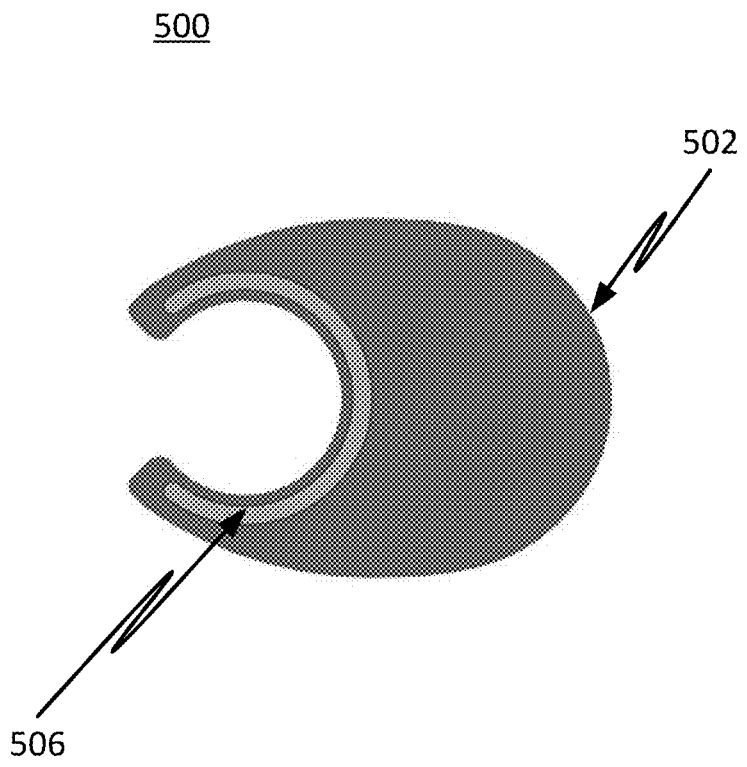
Figure 7:
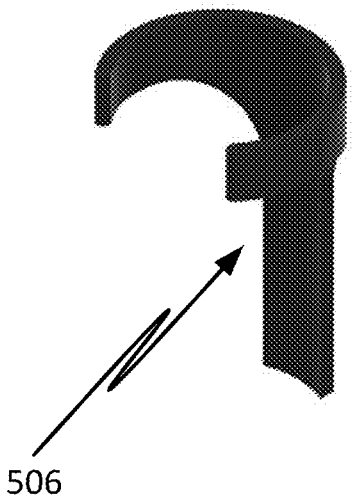

FIGS. 1-3 are diagrams showing an example first embodiment of a vibration reducing clip 100 having a top horizontal portion 102 and a vertical portion 104. As used herein, vertical refers to an axis aligned with that of a bat handle to which the clip can be attached within the retainer clip portion 106 and the bat handle channel 112. Horizontal refers to an axis perpendicular to the vertical axis. When the vibration reducing clip 100 is attached to a bat handle, the retainer clip end portions 108 and 110 extend around the bat handle. Further, the end portions 108 and 110 include exposed sections of an interior clip element 300. The interior clip element 300 includes a horizontal clip section 302 having end portions 108 and 110, and a vertical portion 304. The exposed rigid sections provide enhanced grip on the bat and facilitate retention.

FIGS. 4-7 are diagrams showing an example second embodiment of a vibration reducing clip 400 having a top horizontal portion 402 and a vertical portion 404. The vibration reducing clip 400 is formed of a vibration absorbent material and includes an interior clip element 506 fully encased within the vibration reducing material. The vibration reducing clip 400 also includes a horizontal retainer clip portion 406 and a vertical bat handle channel 408. The absence of exposed ends improves user comfort and aesthetic appeal. The exterior layer may be molded or bonded to the interior structure using techniques such as overmolding or insert molding.

Figure 8:
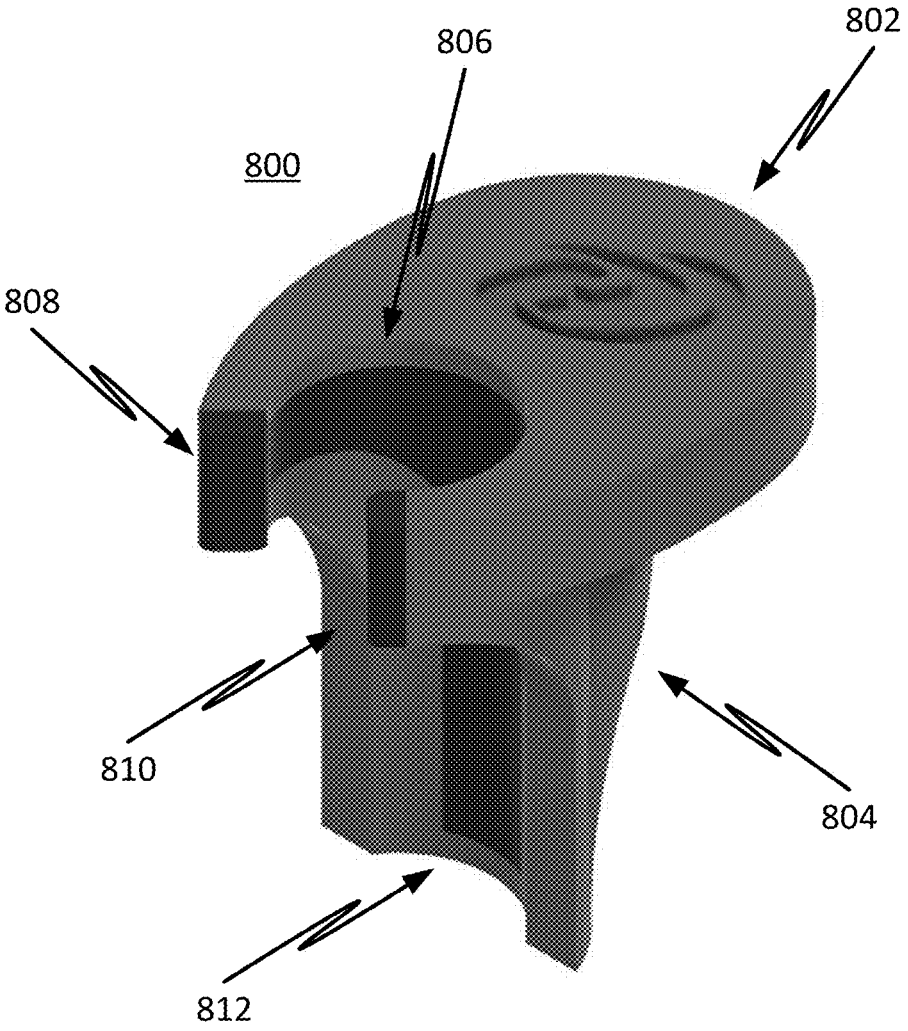
FIGS. 8-10 are diagrams showing an example third embodiment of a vibration reducing clip in accordance with some implementations.
Figure 9:
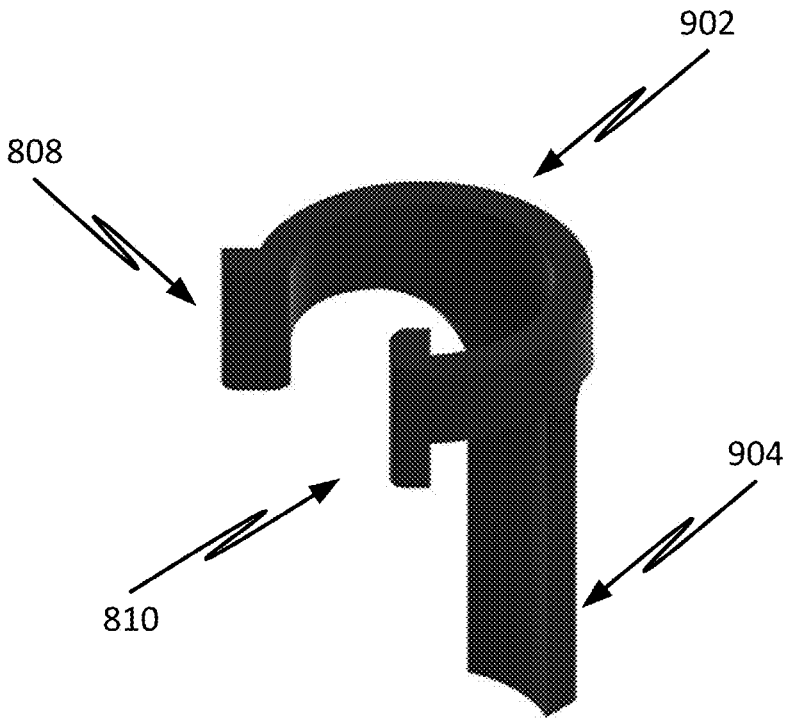
Figure 10:
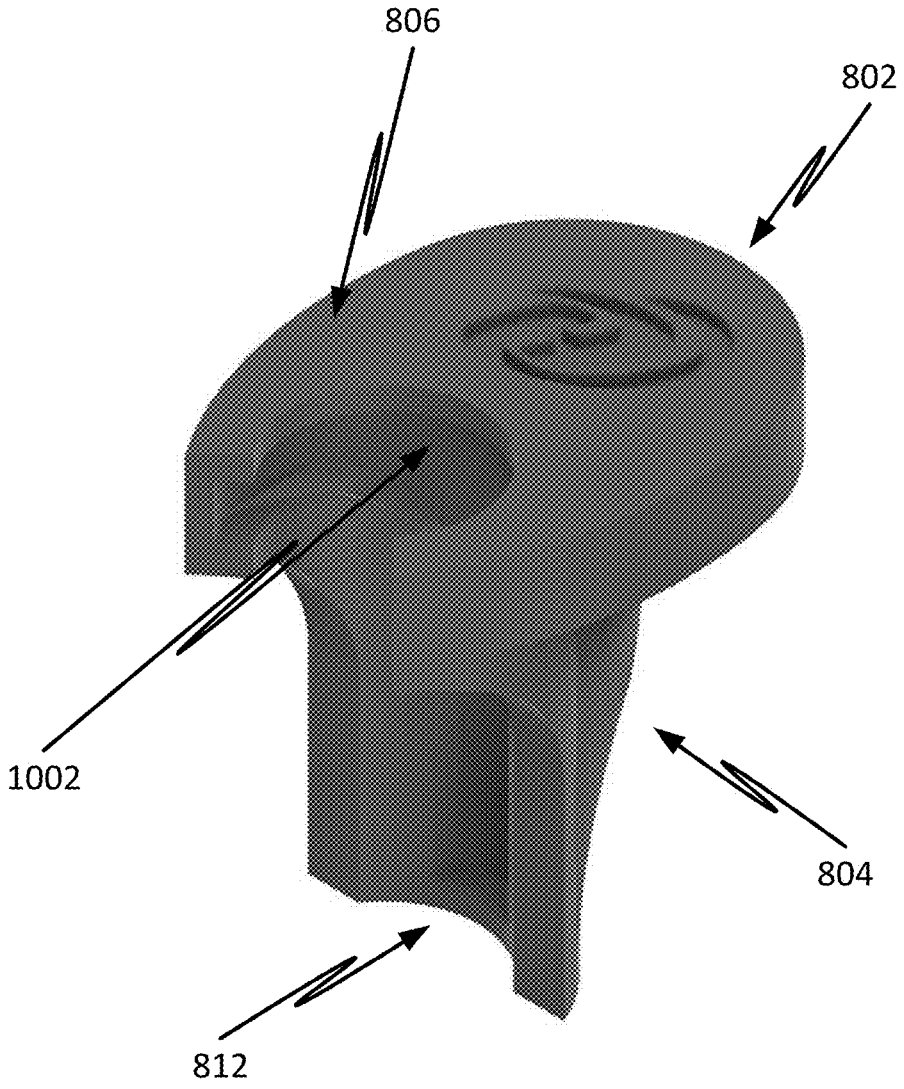

FIGS. 8-10 are diagrams showing an example third embodiment of a vibration reducing clip 800 having a top horizontal portion 802 and a vertical portion 804. The vibration reducing clip 800 includes a horizontal retainer clip portion 806 and a vertical bat handle channel 812. When the vibration reducing clip 800 is attached to a bat handle, exposed retainer clip end portions 808 and 810 extend around the bat handle. The end portions 808 and 810 include exposed sections of an interior clip element 900 as shown in FIG. 9. The interior clip element 900 includes a horizontal clip section 902 having end portions 808 and 810, and a vertical portion 904.

FIG. 10 shows a recess 1002 formed in the outer vibration absorbing portion. The recess 1002 is dimensioned to receive the interior clip element 900, which may be inserted and optionally bonded or left as a pressure-fit component.

As mentioned above, a vibration reducing clip, in accordance with the present disclosure, may comprise a dual-material construction, including a rigid inner clip structure that can be formed of polyvinyl chloride (PVC) with a Shore D hardness of approximately 75, and an outer vibration-dampening (or vibration-absorbing) body composed of polyurethane rubber or silicone rubber with a Shore A hardness of approximately 20.

The design permits easy attachment and removal without modifying the bat and is suitable for use across different bat sizes and styles. The clip structure reduces perceived sting via energy absorption and mechanical isolation.

In addition to the non-limiting example rigid material mentioned above, the interior clip can be formed of materials such as rigid thermoplastics and engineered polymers that offer similar stiffness, impact resistance, and moldability. Below are example suitable alternatives:

1. Acrylonitrile Butadiene Styrene (ABS)
2. High Impact Polystyrene (HIPS)
3. Polycarbonate (PC)
4. Polyethylene Terephthalate (PET)
5. Nylon (Polyamide)

6. Thermoplastic Polyurethane (TPU-Hard Grades)
7. Polyoxymethylene (POM/Acetal)
8. Metal
9. Composite material (e.g., fiberglass, carbon fiber, etc.)

When selecting a material for the inner clip element, these options can be chosen based on specific mechanical needs like rigidity, chemical resistance, or ease of molding.

In addition to the non-limiting example vibration absorbing material discussed above, other materials may be suitable for use as an outer dampening body in applications like the vibration absorbing bat handle clips described herein. Such alternative materials can include:

1. Silicone Rubber (Low Durometer Grades)
2. Natural Rubber (Soft Grades)
3. Thermoplastic Elastomer (TPE)-Soft Grades
4. Ethylene-Vinyl Acetate (EVA) Foam-Soft Density
5. Sorbothane®
6. Butyl Rubber (IIR)-Soft Formulations
7. Neoprene Rubber (CR)-Low Durometer Grades Sorbothane™ may offers the excellent vibration damping per unit thickness, but it is more expensive and less durable than silicone or TPE. Silicone is well suited for extreme environments (temperature, UV exposure). TPE and EVA are cost-effective and suitable for mass production using injection molding.

While some example implementations have been described in terms of a general embodiment with several specific modifications, it is recognized that other modifications and variations of the embodiments described above are within the spirit and scope of the disclosed subject matter. Applicant intends to embrace any and all such modifications, variations, and embodiments.

What is claimed is:

1. A vibration-dampening clip device for attachment to a bat handle, comprising:
- a top horizontal portion;
- a vertical portion;
- a horizontal retainer clip portion and a vertical bat handle channel configured to receive a portion of the bat handle;
- a dual-material construction comprising:
  - an interior clip element formed of a rigid material and having a horizontal clip section and a vertical section, the horizontal clip section including exposed end portions that extend around the bat handle when the clip is attached; and
- an outer vibration-dampening body encasing at least part of the interior clip element and formed of an elastomeric material.

2. The device of claim 1, wherein the rigid material of the interior clip element is polyvinyl chloride (PVC) with a Shore D hardness of approximately 75.

3. The device of claim 1, wherein the outer vibration-dampening body is formed of polyurethane rubber with a Shore A hardness of approximately 20.

4. The device of claim 1, wherein the horizontal retainer clip portion is dimensioned to conform around the cylindrical profile of a bat handle.

5. The device of claim 1, wherein the exposed end portions of the interior clip element are flush with or protrude from the outer body to provide enhanced grip on the bat handle.

6. A vibration-dampening clip device for attachment to a bat handle, comprising:
- a top horizontal portion;
- a vertical portion;
- a horizontal retainer clip portion and a vertical bat handle channel configured to receive a portion of the bat handle;
- an interior clip element formed of a rigid material and completely encased within an outer vibration-dampening body formed of an elastomeric material, wherein the interior clip element does not include any exposed portions.

7. The device of claim 6, wherein the interior clip element is polyvinyl chloride (PVC) and the outer body is polyurethane rubber or silicone rubber.

8. The device of claim 6, wherein the outer vibration-dampening body is molded around the interior clip element to bond with it permanently.

9. The device of claim 6, wherein the interior clip element provides structural rigidity to the device and the outer body provides comfort and shock absorption.

10. A vibration-dampening clip device for attachment to a bat handle, comprising:
- a top horizontal portion;
- a vertical portion;
- a horizontal retainer clip portion and a vertical bat handle channel;
- an interior clip element formed of a rigid material and including a horizontal clip section and a vertical portion, the horizontal clip section having exposed end portions that extend around the bat handle when the device is attached;
- an outer vibration-dampening body formed of an elastomeric material, the body including a recessed portion shaped to receive the interior clip element.

11. The device of claim 10, wherein the interior clip element is removably or permanently inserted into the recessed portion of the vibration-dampening body.

12. The device of claim 10, wherein the exposed end portions of the clip element extend beyond the recessed portion of the outer body to provide enhanced grip.

13. The device of claim 10, wherein the vibration-dampening body comprises polyurethane or silicone rubber.

14. The device of claim 1, wherein the elastomeric outer body includes a textured surface to improve grip and prevent slippage.

15. The device of claim 1, wherein the clip is configured to be removably attachable to bat handles of different diameters.

16. The device of claim 1, wherein the vertical bat handle channel includes an inwardly curved surface to match the cylindrical shape of the bat handle.

17. The device of claim 1, wherein the clip includes color coding or surface markings to indicate size or hardness.

18. The device of claim 1, wherein the clip is formed without requiring any permanent modification to the bat.

19. The device of claim 1, wherein the dual-material construction is configured to reduce perceived sting caused by bat-ball impact.

20. The device of claim 1, wherein the device is formed using injection molding of the outer material around the inner clip element.

* * * * *